US005950715A

United States Patent [19]

Jönsson et al.

[11] Patent Number: 5,950,715

[45] Date of Patent: Sep. 14, 1999

[54] PLATE HEAT EXCHANGER

[75] Inventors: Nils-Åke Jönsson, Staffanstorp; Magnus Källrot, Lund; Ralf Blomgren, Skanör, all of Sweden

[73] Assignee: Alfa Laval AB, Lund, Sweden

[21] Appl. No.: 08/981,161

[22] PCT Filed: May 30, 1996

[86] PCT No.: PCT/SE96/00701

§ 371 Date: Apr. 4, 1998

§ 102(e) Date: Apr. 4, 1998

[87] PCT Pub. No.: WO97/00415

PCT Pub. Date: Jan. 3, 1997

[30] Foreign Application Priority Data

Jun. 16, 1995 [SE] Sweden ..... 9502189

[51] Int. Cl.[6] ..... F28F 27/02

[52] U.S. Cl. ..... 165/103; 165/167; 165/297

[58] Field of Search ..... 165/167, 103, 165/283, 284, 297, 298

[56] References Cited

U.S. PATENT DOCUMENTS

| | | | |
|---|---|---|---|
| 2,291,637 | 8/1942 | Kohlmann | 165/297 |
| 2,360,123 | 10/1944 | Gerstung et al. | 165/298 |
| 3,034,770 | 5/1962 | Hiersch | 165/103 |
| 3,353,590 | 11/1967 | Holman | 165/297 |
| 3,440,833 | 4/1969 | Fernandes | 165/297 X |
| 4,303,124 | 12/1981 | Hessari . | |
| 4,432,410 | 2/1984 | Cadars . | |
| 4,696,341 | 9/1987 | Bolmstedt et al. . | |
| 4,993,367 | 2/1991 | Kehrer | 165/103 |

FOREIGN PATENT DOCUMENTS

| | | | |
|---|---|---|---|
| 316510 | 5/1989 | European Pat. Off. . | |
| 614061 | 9/1994 | European Pat. Off. . | |
| 76935 | 11/1961 | France | 165/103 |
| 2846455 | 10/1979 | Germany | 165/103 |
| 103429 | 10/1963 | Norway | 165/103 |
| 87613 | 10/1936 | Sweden | 165/103 |
| 88669 | 3/1937 | Sweden | 165/103 |
| 114791 | 9/1945 | Sweden . | |
| 116000 | 3/1948 | Sweden . | |
| 365850 | 1/1963 | Switzerland | 165/103 |
| 932381 | 7/1963 | United Kingdom | 165/103 |
| 1190862 | 5/1970 | United Kingdom | 165/103 |

*Primary Examiner*—Leonard Leo
*Attorney, Agent, or Firm*—Fish & Richardson P.C.

[57] ABSTRACT

In a plate heat exchanger the plate interspaces form first flow passages (13, 15; 15*a*) for a first fluid and other flow passages (14) for a second fluid. The plates have openings which for one of the fluids form one inlet channel (10) and one outlet channel (10*a*) through the plate package, the channels communicating with each other through the first flow passages (13, 15; 15*a*). A by-pass passage (15; 15*a*) is formed by at least one of the first flow passages and gives a through flow resistance that is substantially smaller than that given by each one of the other (13) first flow passages. In the inlet channel (10) or the outlet channel (10*a*), or in both channels, a valve member (17; 18; 26) is arranged for setting of a desired flow through the by-pass passage (15; 15*a*).

10 Claims, 3 Drawing Sheets

PLATE HEAT EXCHANGER

FIELD OF THE INVENTION

The present invention relates to a plate heat exchanger, which comprises several plates arranged so that they form a plate package having plate interspaces and in which the plates have through openings forming an inlet channel and an outlet channel through the plate package for liquid, certain of the plate interspaces form first flow passages for said liquid and other plate interspaces form second flow passages for a fluid, which upon through flow of said second flow passages gives off heat to or receives heat from said liquid—through at least some of said plates—when the liquid flows through said first flow passages, and said inlet channel communicates with said outlet channel through said first flow passages.

BACKGROUND OF THE INVENTION

Plate heat exchangers of this kind are well known and are utilized in many different connections.

Sometimes it is desired that part of a liquid to be heat treated is by-passed a plate heat exchanger. In such a case a tubular connection is usually connected outside the plate heat exchanger between its inlet and its outlet for said liquid, a valve being arranged to direct a larger or smaller part of the liquid arriving at the plate heat exchanger through said tubular conduit. If desired, a valve of this kind may be adapted to direct the whole of the liquid flow through either the plate heat exchanger or the conduit. An arrangement of the kind just described is shown for instance in EP-O 122 133-B1.

A conduit of the kind just described requires, however, a relatively large space outside the plate heat exchanger and brings with it additional costs for its connection to the plate heat exchanger inlet and outlet conduits.

It is previously known, e.g. through EP-O 316 510-B1, to make arrangements within a plate heat exchanger for a by-pass flow of a certain part of the liquid supplied to the plate heat exchanger. However, in such a known arrangement a separate casing surrounding the package of heat exchanging plates is necessary. This means that the plate heat exchanger becomes substantially more expensive than if the casing could be dispensed with. In the known arrangement according to EP-O 316 510-B1 it is further impossible to pump said liquid into the plate heat exchanger by a high pressure, since the by-passing of part of the liquid is intended to take place through an overflow outlet within said casing.

SUMMARY OF THE INVENTION

The object of the present invention is to provide a plate heat exchanger of the initially defined kind, which has a relatively unexpensive arrangement for by-passing at least part of the liquid supplied to the plate heat exchanger, so that this part of the liquid is not subjected to, or subjected only to a small degree, to heat treatment within the plate heat exchanger.

This object can be fulfilled according to the invention in a way such that said first flow passages comprise several heat exchange passages, which are adapted for an effective heat transfer between said liquid and said fluid and which are shaped such that each one of them gives a certain flow resistance for through flow of said liquid, and also at least one by-pass passage, which is adapted for a less effective or no heat transfer between said liquid and said fluid and which is shaped such that it gives a flow resistance substantially smaller than that given by each one of said heat exchange passages, and that at least one valve member is arranged movable between different positions to make possible obtainment of a desired liquid flow through the by-pass passage.

A by-pass passage of the kind here defined can be arranged in any desired part of said plate package. Preferably, the by-pass passage is formed in one of the outermost plate interspaces in the plate package, i.e. one end plate of the plate package is used to delimit the by-pass passage. A plate package end plate of this kind is often completely planar, i.e. it is not as the real heat transfer plates provided with tubulence generating corrugations or the like. Thereby, the distance between the two plates which are to delimit the by-pass passage need not be particularly large in order to give the by-pass passage a relatively large through flow capacity.

If the by-pass passage is to be delimited between two plates having pressed corrugation patterns of ridges and valleys, the ridges and valleys present in the by-pass passage preferably have a different shape and/or direction than the ridges and valleys present in one of said heat exchange passages. In a case like this the through flow area of the by-pass passage need not necessarily be larger than that of a heat exchange passage.

Within the scope of the invention the by-pass passage may be formed of several flow passages coupled in parallel, each one of which is formed exactly like one of said heat exchange passages. Several such flow passages coupled in parallel give together a flow resistance for a flow therethrough, which is substantially smaller than the flow resistance given by each one of the heat exchange passages.

Said valve member, which may be arranged within the by-pass passage but preferably is arranged in either the inlet channel or the outlet channel of the plate package, may within the scope of the invention be formed in different ways. According to a preferred embodiment of the invention the valve member comprises a sleeve situated either in the inlet channel or in the outlet channel. The sleeve may for instance be adapted to fulfil a valve function by being rotated around the longitudinal axis of the inlet channel or the outlet channel, but preferably the sleeve is axially displaceable along said longitudinal axis.

The valve member may be arranged and formed such that it admits through flow of said heat exchange passages independent of its position, or such that it prevents through flow of the heat exchange passages when the by-pass passage is kept fully open for through flow, or vice versa. Of course it may be arranged and formed such that it is adjustable to any desired position between two end positions in order to make possible a desired distribution of a liquid flow entering the plate heat exchanger between the by-pass passage and the heat exchange passages.

The invention can be used in different types of plate heat exchangers, such as brazed or welded plate heat exchangers or plate heat exchangers having gaskets arranged between some or all of the plates in the plate package.

BRIEF DESCRIPTION OF THE DRAWINGS

The invention will be described in the following with reference to the accompanying drawings, in which.

DETAILED DESCRIPTION

Figure 1:
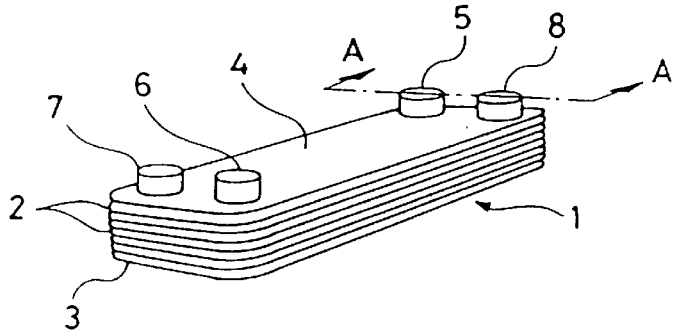
FIG. 1 shows a so called brazed plate heat exchanger.
Figure 2:
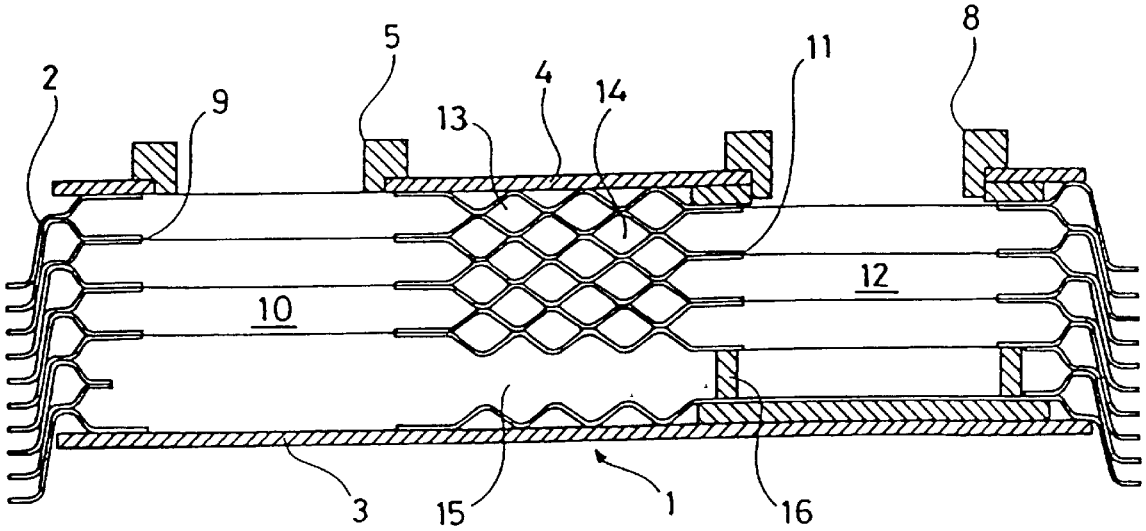
FIG. 2 shows a section through the plate heat exchanger in FIG. 1, taken along the line A—A, the FIGS. 3 and 4 show schematical sections of a plate heat exchanger according to a particular embodiment of the invention, and FIGS. 5 and 5 schematically show a section and a view, respectively, of a plate heat exchanger according to a further embodiment of the invention.

FIG. 1 shows a so called brazed plate heat exchanger 1, which comprises a package of stacked and brazed together rectangular plates 2–4 and connection pipes 5–8 for two liquids between which heat is to be transferred in the plate heat exchanger. As illustrated in FIG. 2 the plates 2 are corrugated thin heat transfer plates, whereas the plates 3 and 4 are somewhat thicker plane plates constituting end plates in the plate package. The connection pipes 5 and 6 form an inlet and an outlet, respectively, for one of said liquids and the connection pipes 7 and 8 form an inlet and an outlet, respectively, for the other one of said liquids.

The heat transfer plate 2 and the end plate 4 have in their corner portions through openings aligned with the connection pipes and forming inlet channels and outlet channels, respectively, through the plate package for said liquids. In FIG. 2 opening 9 in the heat transfer plates 2, thus, form an inlet channel 10 through the plate package for said one liquid, whereas openings 11 in the same plates form an outlet channel 12 for said other liquid.

The heat transfer plates 2 have a press pattern of ridges and valleys, the ridges of adjacent plates crossing and abutting against each other. At all places where ridges of this kind abut against each other the adjacent plates are connected with each other through brazing.

By means of said ridges the plates 2 are kept spaced from each other, so that flow passages for said liquids are formed between the plates. Thus, there is formed in every second plate interspace a flow passage 13 for said one liquid and in the rest of the plate interspaces there are formed flow passages 14 for the other liquid.

The plates 2 are brazed together in pairs in said inlet and outlet channels in a way such that only said one liquid has access to the flow passages 13 and only the other liquid has access to the flow passages 14.

As can be seen from FIG. 2 central portions of two heat transfer plates 2 are missing, whereby a flow passage 15 has been formed which communicates with the inlet channel 10. This flow passage 15 also communicates with the outlet channel through the package, which is not shown but which is situated opposite to the connection pipe 6 (FIG. 1). A ring 16 is fastened by brazing around the outlet channel 12 in the flow passage 15, so that the latter does not communicate with the outlet channel 12. A ring of the same kind (not shown) is arranged in the flow passage 15 around the inlet channel that is not shown but is situated opposite to the inlet pipe 7 (FIG. 1).

The flow passage 15, which has a through flow area three times as large as that of each one of said flow passages 13, is coupled in parallel with these flow passages 13 and forms a so called by-pass passage within and through the plate heat exchanger for said one liquid.

For a desired control of the flow of said one liquid through the flow passages 13 and the flow passage 15 the plate heat exchanger may be provided with one or more valve members. Different types of such valve members are shown in the FIGS. 3–5 and are described in the following.

In the FIGS. 3–6 the same reference numerals are used as in the FIGS. 1 and 2 for details having counterparts in the FIGS. 1 and 2.

Figure 3:
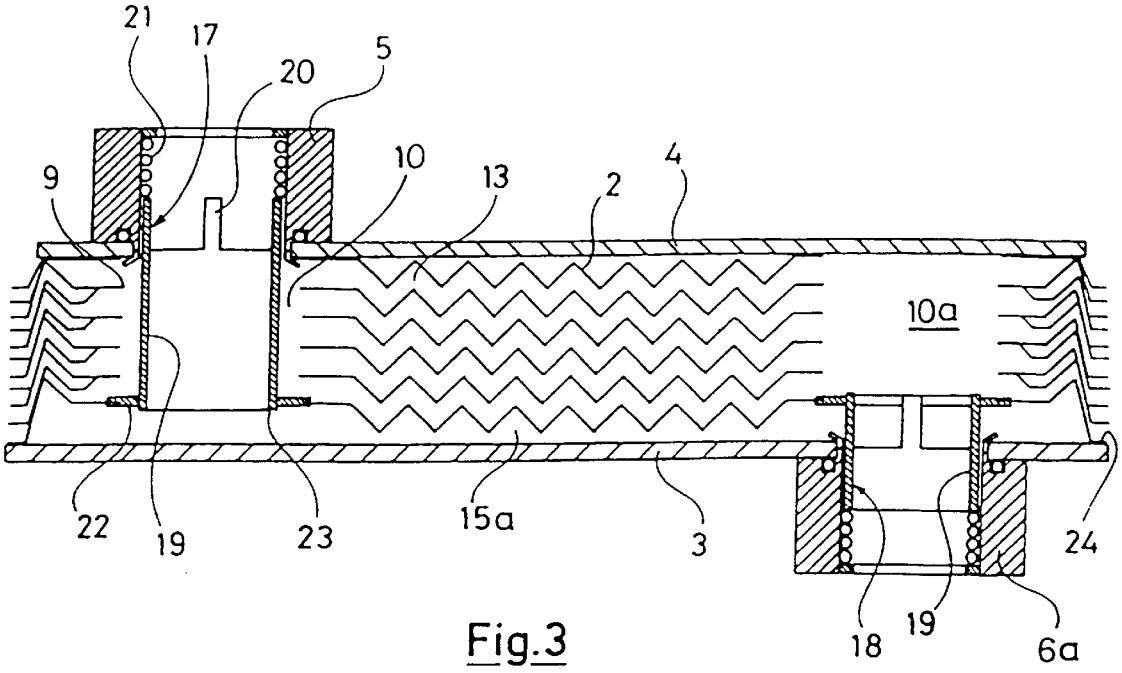
Figure 4:
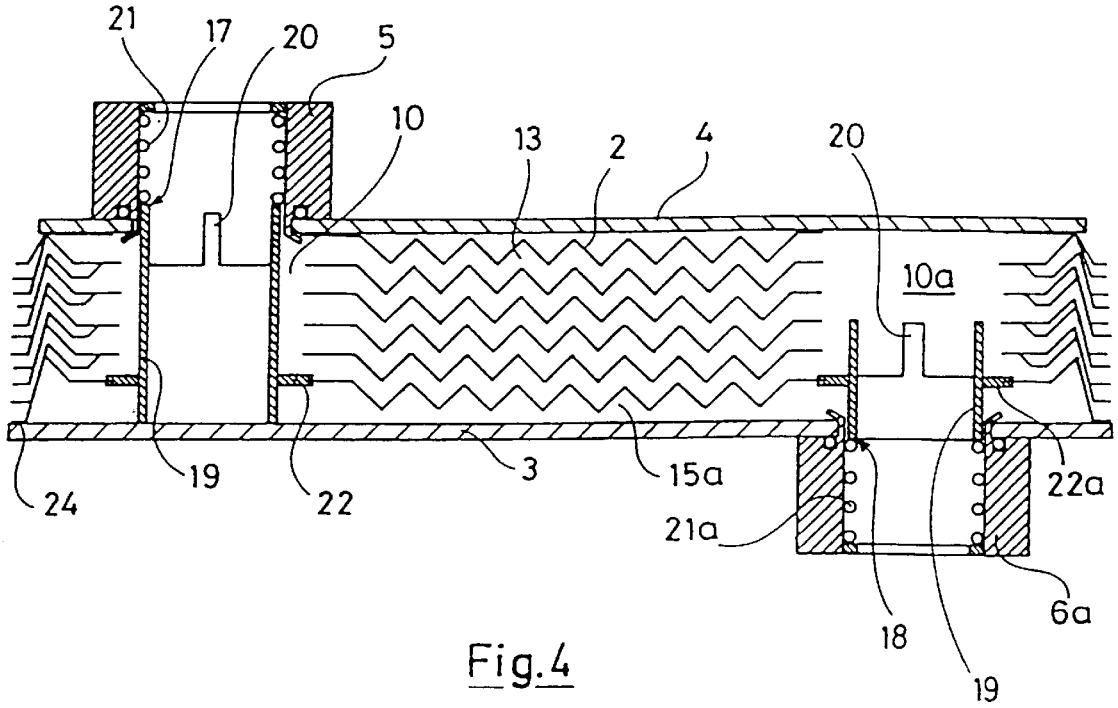

In the very schematical FIGS. 3 and 4 there is illustrated a plate heat exchanger intended for cooling of a hot first liquid by means of a cold second liquid. In the drawing only the flow passages 13 and 15*a* for said first liquid are shown. The other flow passages, intended for the second liquid, are of course present but are not shown in the figures. The flow passage 15*a*, which forms a by-pass passage having a smaller flow resistance than each one of the flow passages 13, is formed in this case between the plane end plate 3 and the lowermost heat transfer plate 2 situated closest to said end plate 3. The outlet pipe 6*a* for said first liquid is in this case connected to the lower end plate 3 which, therefore, has a through opening aligned with the outlet pipe 6*a* and with the outlet channel 10*a* of the plate package for said first liquid. The inlet channel 10 and the outlet channel 10*a*, thus, communicate with each other through the flow passages 13 and 15*a*.

A first valve member 17 is arranged in the inlet channel 10 and a second valve member 18 is arranged in the outlet channel 10*a*. Each valve member comprises a cylindrical part or sleeve 19 and at one end thereof several axial protuberances 20 distributed, spaced from each other, around the center axis of the sleeve.

The first valve member 17 extends with its protuberances 20 somewhat axially into the connection pipe 5 and abuts therein axially against an actuation member 21. At its end portion situated closest to the end plate 3 the valve member is surrounded sealingly by an-annular sealing member 22 connected with the heat transfer plate 2 which delimits the by-pass passage 15*a*. The valve member 17 is axially movable between a first position, that can be seen from FIG. 3, and a second position that can be seen from FIG. 4. In the position according to FIG. 3 the protuberances 20 are situated completely within the inlet pipe 5, and therefore liquid entering the plate heat exchanger is conducted through the inlet pipe 5 axially through the whole of the valve member 17 and into the by-pass passage 15*a*. In this position of the valve member 17 the liquid consequently can not flow into the flow passages 13.

The actuation member 21 may be constituted by a temperature controlled spring of memory metal, which operates in the following way. If incoming liquid has a temperature lower than a predetermined temperature, the spring takes a shape which can be seen from FIG. 3, so that liquid flows to and into the by-pass passage 15*a*. If, instead, the liquid temperature exceeds the predetermined temperature by more than a certain value, the spring takes a shape which can be seen from FIG. 4, so that the valve member 17 is pressed against the end plate 3. Then all liquid is conducted between the protuberances 20 to the inlet channel 10 and further into the flow spaces 13. The sealing member 22 prevents liquid from entering the by-pass passage 15*a*.

In the outlet channel 10*a* there is also an annular sealing member 22*a* connected with the heat transfer plate 2, that delimits the by-pass passage 15*a*, and surrounding the valve member 18. An actuation member 21*a* is arranged in the outlet pipe 6*a* for actuation of the valve member 18.

In this case the valve member 18 extends with its sleeve 19 into the outlet pipe 6*a*, whereas the axial protuberances 20 are situated in the outlet channel 10*a* all the time. The valve member 18 can not prevent communication between the flow passages 13 and the interior of the outlet pipe 6*a*. In a position that can be seen from FIG. 3 the valve member 18 keeps open a communication between the by-pass passage 15*a* and the interior of the outlet pipe 6*a*, but when the valve member is situated in a position according to FIG. 4 it keeps this communication closed.

The actuation member 21*a* can operate in a way similar to that of the actuation member 21 and for instance be adapted to keep the valve member 18 in the position according to FIG. 4, so that the by-pass passage is closed, as soon as it is influenced by liquid having a temperature exceeding a predetermined temperature.

It is not always necessary to use valve members in both the inlet channel 10 and the outlet channel 10*a*. This can sometimes be desirable, however, e.g. as an additional safety for said hot first liquid not to leave the plate heat exchanger with a temperature exceeding a certain temperature.

Actuation members of a different kind than the one described above may be arranged, of course, to actuate the valve members in the inlet and outlet channels 10 and 10*a*, respectively.

As can be seen from the FIGS. 3 and 4, the heat transfer plates 2 have edge portions 24 which are bent in the same direction. In a pair of adjacent plates 2 the edge portion of one of the plates partly overlaps the edge portion of the other plate. The lowermost heat transfer plate 2 in the FIGS. 3 and 4 abuts with its bent edge portion 24 against the end plate 3, so that the by-pass passage 15*a* becomes relatively wide.

Figure 5:
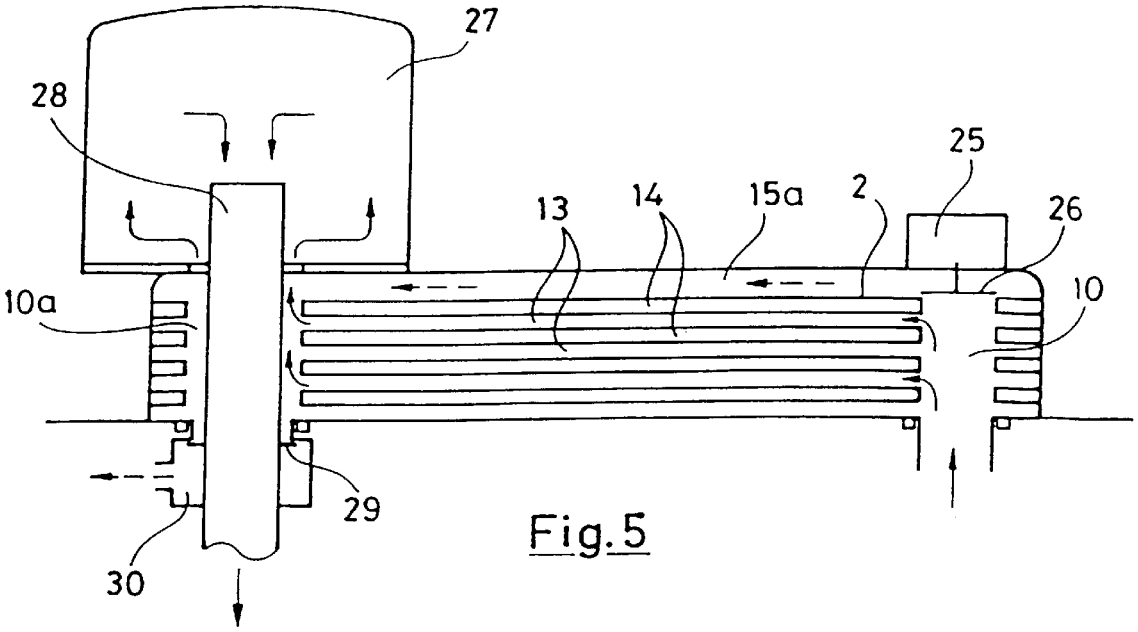
Figure 6:
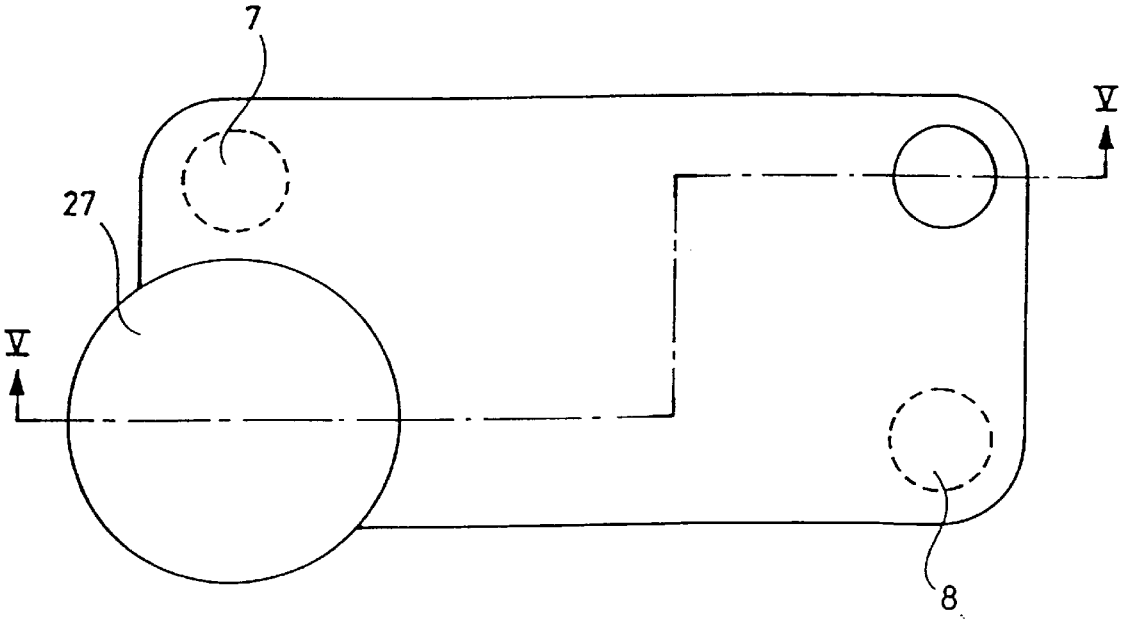

The FIGS. 5 and 6 show schematically in cross section and in view, respectively, a brazed plate heat exchanger according to the invention, intended for cooling of oil by means of water. The plate heat exchanger is connected with a filter for cleaning of the oil after it has passed through the plate heat exchanger. FIG. 5 is a section taken along the line V—V in FIG. 6.

The plate heat exchanger in FIGS. 5 and 6 is provided with an actuation means 25 arranged to actuate a valve member 26, so that it can take different positions in an inlet channel 10 for oil. In the position of the valve member 26 shown in FIG. 5 it closes in corporation with a heat transfer plate 2 a connection between the inlet channel 10 and a by-pass passage 15*a*. All incoming oil is conducted then through first heat exchange passages 13 to an outlet channel 10*a* and is then cooled by water flowing through other heat exchange passages 14. The latter communicate with an inlet 7 and an outlet 8 for water, illustrated by dotted lines in FIG. 6.

The outlet channel 10*a* for oil communicates with the interior of a filter 27, the outlet of which is formed by a pipe 28. This pipe 28 extends axially through the central part of the outlet channel 10*a* and further out thereof.

Alternatively, oil may leave the outlet channel 10*a* through a pressure controlled outlet valve 29, if the oil pressure exceeds a predetermined value.

The actuation means 25 may have any suitable construction. As an example, it may be constituted by a small electric motor or by a pneumatically actuable piston/cylinder unit. The actuation means may be adapted either to keep the valve member in one of two end positions or to adjust the valve member into any desired position between two end positions, so that any desired portion of the oil entering the inlet channel 10 may be conducted into and through the by-pass passage 15*a*.

For its function the actuation means may be adapted to be controlled by some suitable parameter, such as temperature, pressure or viscosity of for instance the oil to be treated or has been treated in the plate heat exchanger.

What is claimed is:

1. A plate heat exchanger, which comprises a plurality of plates (2–4) arranged to form a plate package having plate interspaces and in which the plates have through openings forming an inlet channel (10) and an outlet channel (10*a*) through the plate package for a liquid, certain of the plate interspaces form first flow passages (13, 15, 15*a*) for said liquid and other plate interspaces form second flow passages (14) for a fluid, which upon through flow of said second flow passages (14) gives off heat to or receives heat from said liquid—through at least some of said plates—when the liquid flows through said first flow passages (13, 15, 15*a*), and said inlet channel (10) communicates with said outlet channel (10*a*) through said first flow passages (13, 15, 15*a*), wherein said first flow passages comprise a plurality of heat exchange passages (13), which are adapted for an effective heat transfer between said liquid and said fluid, and are shaped to provide a certain flow resistance for through flow of said liquid, and at least one by-pass passage (15, 15*a*), which is adapted for a less effective or no heat transfer between said liquid and said fluid, and is shaped to provide a through flow resistance substantially smaller than that provided by each one of said heat exchange passages (13), further wherein at least one valve member (17, 18, 26) is provided and is arranged to move to different positions in order to provide a desired liquid flow rate through the at least one by-pass passage (15, 15*a*), further wherein the at least one by-pass passage (15, 15*a*) is formed between two plates, one of which is an end plate (3) in said plate package, so that a main plane of the at least one by-pass passage differs from, but is substantially in parallel with, a main plane of each one of said heat exchange passages, and further wherein the through flow area of the at least one by-pass passage (15, 15*a*) is larger than that of each one of said heat exchange passages (13).

2. A plate heat exchanger according to claim 1, in which every second plate interspace forms one of said first flow passages (13,15;15*a*) and the rest of the plate interspaces form said second flow passages (14).

3. A plate heat exchanger according to claim 1, in which at least one of the plates delimiting the at least one by-pass passage (15;15*a*) is substantially planar.

4. A plate heat exchanger according to claim 1, in which said valve member (17;18;26) is adjustable only into two positions; one position in which the at least one by-pass passage (15;15*a*) is kept open for through flow of said liquid and another position in which such through flow is prevented.

5. A plate heat exchanger according to claim 1, in which said valve member (17;18;26) is arranged in one of the inlet channel (10) or the outlet channel (10*a*).

6. A plate heat exchanger according to claim 5, in which the valve member (17;18) comprises a sleeve.

7. A plate heat exchanger according to claim 5, in which the valve member (17;18;26) is movable in the longitudinal direction of the inlet channel (10) or the outlet channel (10*a*), respectively.

8. A plate heat exchanger according to claim 5, in which the valve member (17) is arranged and formed such that it prevents through flow to the heat exchange passsages (13), when the at least one by-pass passage (15*a*) is kept open for through flow.

9. A plate heat exchanger according to claim 5, in which the valve member (17) is arranged and formed-such that it permits through flow in the heat exchange passages (13), when the at least one by-pass passage (15*a*) is closed for through flow.

10. A plate het exchanger according to claim 1, in which each one of the inlet channel (10) and the outlet channel (10*a*) contains a valve member.

* * * * *